US007407522B2

(12) United States Patent
Jakush et al.

(10) Patent No.: US 7,407,522 B2
(45) **Date of Patent: *Aug. 5, 2008**

(54) STABILE INVERT FUEL EMULSION COMPOSITIONS AND METHOD OF MAKING

(75) Inventors: Edward A. Jakush, Evanston, IL (US); Gerald N. Coleman, Peoria, IL (US); Dennis L. Endicott, Mapleton, IL (US); Alex Nikolov, Chicago, IL (US)

(73) Assignee: Clean Fuels Technology, Inc., Reno, NV (US)

( * ) Notice: Subject to any disclaimer, the term of this patent is extended or adjusted under 35 U.S.C. 154(b) by 493 days.

This patent is subject to a terminal disclaimer.

(21) Appl. No.: 10/766,686

(22) Filed: Jan. 27, 2004

(65) Prior Publication Data

US 2004/0255509 A1 Dec. 23, 2004

Related U.S. Application Data

(63) Continuation of application No. 09/108,232, filed on Jul. 1, 1998, now abandoned.

(51) Int. Cl.
*C10L 1/32* (2006.01)

(52) U.S. Cl. ..... 44/301; 44/302; 516/21; 516/53

(58) Field of Classification Search ..... 44/301, 44/302; 516/21, 53

See application file for complete search history.

(56) References Cited

U.S. PATENT DOCUMENTS

| | | | | |
|---|---|---|---|---|
| 3,615,290 | A * | 10/1971 | Nixon | 44/301 |
| 4,770,670 | A | 9/1988 | Hazbun et al. | 44/51 |
| 5,284,492 | A | 2/1994 | Dubin | 44/301 |
| 5,344,306 | A | 9/1994 | Brown et al. | 431/4 |
| 5,584,894 | A | 12/1996 | Peter-Hoblyn et al. | 44/301 |
| 5,669,938 | A | 9/1997 | Schwab | 44/301 |
| 5,743,922 | A | 4/1998 | Peter-Hoblyn et al. | 44/301 |
| 5,873,916 | A | 2/1999 | Cemenska et al. | 44/301 |
| 6,607,566 | B1 * | 8/2003 | Coleman et al. | 44/301 |
| 6,656,236 | B1 * | 12/2003 | Coleman et al. | 44/301 |

FOREIGN PATENT DOCUMENTS

| | | |
|---|---|---|
| EP | 0 301 766 A1 | 2/1989 |
| EP | 0 301 766 B1 | 3/1993 |
| WO | WO 79/00211 | 4/1979 |
| WO | WO 93/07238 | 4/1993 |
| WO | WO 95/27021 | 10/1995 |
| WO | WO 98/12285 | 3/1998 |

* cited by examiner

*Primary Examiner*—Cephia D Toomer
(74) *Attorney, Agent, or Firm*—Lewis and Roca LLP

(57) ABSTRACT

The present method for producing a high stability, low emission, invert fuel emulsion composition comprises blending additives having a surfactant package with a hydrocarbon petroleum distillate fuel in an in-line blending station to create a composition. The surfactant package includes a primary surfactant, a block copolymer, and a polymeric dispersant, and the hydrocarbon petroleum distillate fuel is a continuous phase of the emulsion. The method also comprises blending purified water with the composition in a second in-line blending station to produce a second composition and aging the second composition in a reservoir to produce an aged composition and passing the aged composition through a shear pump to a storage tank.

19 Claims, 2 Drawing Sheets

STABILE INVERT FUEL EMULSION COMPOSITIONS AND METHOD OF MAKING

CROSS-REFERENCE TO RELATED APPLICATIONS

This application is a continuation of U.S. patent application Ser. No. 09/108,232, filed Jul. 1, 1998, now abandoned.

BACKGROUND

The present invention relates to fuel compositions having reduced nitrogen oxide (NOx) emission, more particularly, to high stability, low emission, fuel emulsion compositions for use in internal combustion engines.

Nitrogen oxides comprise a major irritant in smog and are believed to contribute to tropospheric ozone, which is a known threat to health. Environmental considerations and government regulations have increased the need to reduce NOx production. Various methods for reducing NOx production include the use of catalytic converters, engine timing changes, exhaust recirculation, and the burning of "clean" fuels. These methods are generally too expensive and/or too complicated to be placed in widespread use.

High flame temperatures reached in internal combustion engines, for example diesel-fueled engines, increase the tendency for the production of nitrogen oxides (NOx). These are formed from both the combination of nitrogen and oxygen in the combustion chamber and from the oxidation of organic nitrogen species in the fuel. The rates at which NOx are formed is related to the flame temperature; a small reduction in flame temperature can result in a large reduction in the production of nitrogen oxides.

It has been shown that introducing water into the combustion zone can lower the flame temperature and thus lower NOx production, however; the direct injection of water requires costly and complicated changes in engine design. Further attempts to use water to reduce flame temperature include the use of aqueous fuels, i.e., incorporating both water and fuel into an emulsion. Problems that may occur from long-term use of aqueous fuels include engine corrosion, engine wear, or precipitate deposition, which may lead to engine problems and ultimately to inoperability. Problematic precipitate depositions include coalescing ionic species resulting in filter plugging and inorganic post combustion deposits resulting in turbo fouling. Another problem related to aqueous fuel compositions is that they often require substantial engine modifications, such as the addition of in-line homogenizers, thereby limiting their commercial utility.

Another method for introducing water into the combustion area is to use fuel emulsions in which water is emulsified into a fuel continuous phase, i.e., invert fuel emulsions. A problem with these invert fuel emulsions is obtaining and maintaining the stability of the emulsion under conventional use conditions and at a reasonable cost. Gravitational phase separation (during storage) and high temperature high pressure/shear flow rate phase separation (in a working engine) of these emulsions present the major hurdle preventing their commercial use.

The present invention addresses the problems associated with the use of invert fuel emulsion compositions by providing a stabile, inexpensive invert fuel emulsion composition with the beneficial reduction in NOx and particulate emissions.

SUMMARY

The present invention features fuel compositions comprised of a hydrocarbon petroleum distillate fuel, purified water, and a surfactant package. The fuel composition preferably is in the form of an emulsion in which the fuel is the continuous phase. The invert fuel emulsion compositions are stable at storage temperatures, as well as, at temperatures and pressures encountered during use, such as, during recirculation in a compression ignited engine. The invert fuel emulsion compositions have reduced NOx and particulate emissions and are substantially ashless.

The amount of the hydrocarbon petroleum distillate fuel preferably is between about 50 weight percent and about 95 weight percent of the invert fuel emulsion composition, more preferably between about 68 weight percent and about 80 weight percent of the invert fuel emulsion composition.

The amount of purified water preferably is between about 5 weight percent and about 50 weight percent of the fuel composition, more preferably between about 20 weight percent and about 30 weight percent of the fuel composition. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon.

The invert fuel emulsion composition includes a surfactant package preferably comprising a primary surfactant, a block-co-polymer, and one or more surfactant enhancers.

Other additives such as antifreezes, ignition delay modifiers, cetane improvers, lubricants, corrosion inhibitors, stabilizers, rheology modifiers, and the like, and may also be included. Individual ingredients may perform one or more of the aforementioned functions.

The process for making the invert fuel emulsion compositions aids in the achievement of the desired droplet size and greatly effects the stability of the resulting invert fuel emulsion compositions. The components are mixed in a serial, continuous flow process. This process allows for the continuous monitoring and instantaneous adjustment of the flow, and thus content, of each component in the final mixture. After all components are mixed, the composition is aged prior to passing it through a shear pump. The aging time is temperature dependent. The resulting emulsion is a micro-emulsion having an average droplet size of about 1 micron or less.

DETAILED DESCRIPTION

Figure 1:
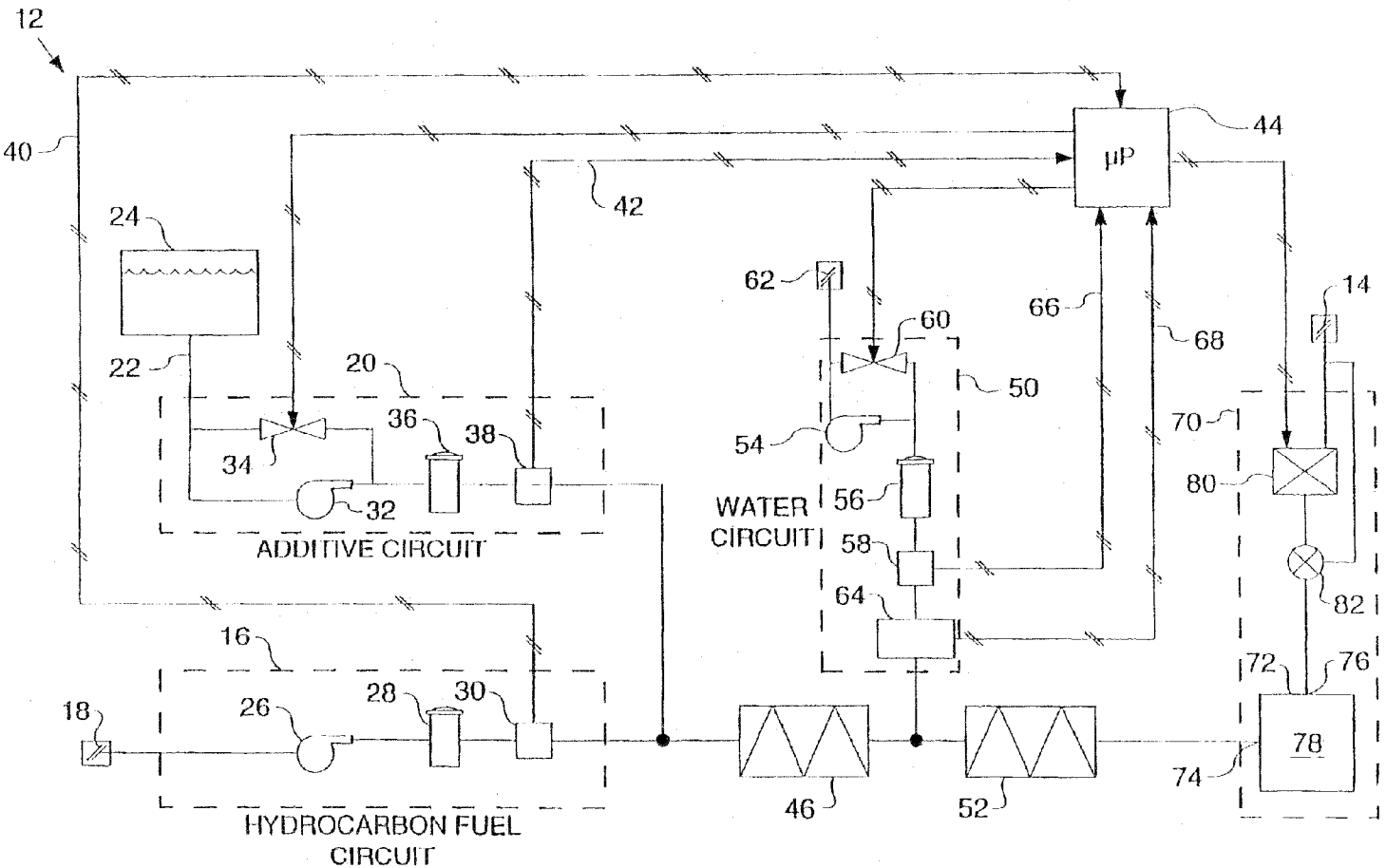
FIG. 1 is a schematic representation of an emulsion blending system.

Applicant hereby incorporates by reference herein all of the information, including tables and figures, disclosed in application Ser. No. 09/108,232, filed Jul. 1, 1998, entitled, "STABILE INVERT FUEL EMULSION COMPOSITIONS AND METHOD OF MAKING."

Invert fuel emulsion compositions of the present invention include hydrocarbon petroleum distillate fuel and water in the form of an emulsion in which the fuel is the continuous phase. The preferred emulsion is a stable system with as little surfactant as possible. A stable emulsion is desirable because a separate water phase will lead to combustion problems. Stability means no substantial phase separation in long term storage under typical storage conditions, for example, up to about three months. High temperature, high pressure stability is also required to maintain the emulsion under operating conditions.

The fuel composition is preferably ashless. For the purposes of this disclosure "ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units. The level of ash is determined by monitoring water purity, exhaust emissions, and by engine autopsy. Engine autopsy, including dismantlement and metallurgical analysis, is also used to analyze corrosion and wear.

Preferred compositions include about 50% to about 95% by weight hydrocarbon petroleum distillate fuel, more preferably about 68% to about 80% hydrocarbon petroleum distillate fuel. Examples of suitable hydrocarbon petroleum distillate fuels include kerosene, diesel, naphtha, and aliphatics and paraffinics, used alone or in combination with each other. Preferred diesels include but are not limited to, for example, EPA Emissions Certification diesel and standard number 2 diesel. The amount and type of hydrocarbon petroleum distillate fuel is selected so that the kilowattage per gallon provided by combusting the fuel composition is sufficiently high so that the engine need not be derated. Other suitable hydrocarbon petroleum distillate fuels also include high paraffinic, low aromatic hydrocarbon petroleum distillates having an aromatic content of less than about 10%, preferably less than about 3%.

The water phase contributes to the reduction of NOx and particulate emissions. The greater the amount of water, the greater the decrease in NOx emissions. The current upper limit of water is about 50%, above which the burning characteristics of the fuel make it's use impractical under normal conditions, i.e., with an acceptable amount of additives and relatively inexpensive hydrocarbon petroleum distillate. The preferred amount of purified water is between about 10 weight percent and about 50 weight percent of the fuel composition, more preferably between about 20 weight percent and about 30 weight percent of the fuel composition.

The water is preferably purified such that it contains very low concentrations of ions and other impurities, particularly calcium ions, magnesium ions, and silicon. This is desirable because impure water contributes to ashing and engine deposit problems after long-term use, which can lead to wear, corrosion, and engine failure. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon. Suitable purification techniques are well-known and include distillation, ion exchange treatment, and reverse osmosis, with reverse osmosis being preferred.

In a preferred embodiment the pH of the purified water is adjusted to about 4 to about 7, preferably from about 5 to about 6. The acidity helps the water droplets form more easily and thus enhances emulsion formation as well as having an anti-corrosion effect. The water can be acidified with any compatible acid, preferably an organic acid, more preferably citric acid.

The composition includes a surfactant package which facilitates the formation of a stable emulsion of the purified water within the continuous hydrocarbon petroleum distillate fuel phase. A preferred surfactant package is comprised of a primary surfactant in combination with one or more surfactant stabilizers and enhancers. Components of preferred surfactant packages are ashless and do not chemically react with other components in the fuel composition. Preferred invert fuel emulsion compositions include about 0.3% to about 1.0% by weight, preferably about 0.4% to about 0.6% total surfactant package.

Examples of suitable primary surfactants include nonionic, anionic and amphoteric surfactants. Preferred primary surfactants include charged amide surfactants, more preferably unsubstituted, mono- or di-substituted amides of saturated or unsaturated $C_{12}$-$C_{22}$ fatty acids. The amide is preferably substituted with one or two groups selected independently of each other from straight, branched, unsubstituted and substituted alkyls or alkanols having 1 to 4 carbon atoms and aryls. An example of a preferred amide primary surfactant is a 1:1 fatty acid diethanolamide, more preferably a diethanolamide of oleic acid (commercially available as Schercomid SO-A from Scher Chemical). The primary surfactant is present in the invert fuel emulsion composition in the range of about 3,000 ppm to about 10,000 ppm, more preferably about 5,000 ppm to about 6,000 ppm.

The surfactant package preferably includes one or more block copolymers. The block copolymers of the surfactant package act as a stabilizer of the primary surfactant. Suitable block copolymers may have surfactant qualities, however; it is believed, this belief having no limitation on the scope or operation of this invention, that the unexpected, superior results of the present invention are a result of a 'synergistic' effect of the block copolymer in combination with the primary surfactant. The block copolymer acts as a stabilizer of the primary surfactant at the interface. Examples of suitable block copolymers for the surfactant package include high molecular weight block copolymers, preferably ethylene oxide (EO)/propylene oxide (PO) block copolymers such as octylphenoxypolyethoxyethanol (a block copolymer produced by BASF as PLURONIC 17R2). Examples of preferred block copolymers include PLURONIC 17R2, PLURONIC 17R4, PLURONIC 25R2, PLURONIC L43, PLURONIC L31, and PLURONIC L61, all commercially available from BASF. The block copolymer is present in the invert fuel emulsion composition in the range of about 1,000 ppm to about 5,000 ppm, more preferably about 2,000 ppm to about 3,000 ppm.

The surfactant package preferably includes one or more high molecular weight polymeric dispersants. The polymeric dispersant acts as a surfactant enhancer/stabilizer, stabilizing the primary surfactant and contributing to the synergistic combination of the primary surfactant and block copolymer. A preferred polymeric dispersant is HYPERMER E-464 commercially available from ICI. Other suitable polymeric dispersants include HYPERMER A-60 from ICI, a decyne diol nonfoaming wetter such as SURFINAL-104 produced by Air Products, an amineoxide such as BARLOX BX12 from Lonza, and EMULSAN a bio-polymer surfactant from Emulsan. The polymeric dispersant is present in the invert fuel emulsion composition in the range of about 100 ppm to about 1,000 ppm, more preferably about 700 ppm to about 800 ppm.

The composition may also include one or more additives, for example, antifreezes, ignition delay modifiers, cetane improvers, stabilizers, lubricants, corrosion inhibitors, rheology modifiers, and the like. The amount of additive selected is preferably sufficiently high to perform its intended function and, preferably sufficiently low to control the fuel composition cost. The additives are preferably selected so that the fuel composition is ashless.

An antifreeze may also be included in the fuel composition. Organic alcohols are preferred. Specific examples include methanol, ethanol, isopropanol, and glycols, with methanol being preferred. The amount of antifreeze is preferably less than about 15%, more preferably ranging from about 2% to about 9% by weight.

The fuel composition may also include one or more ignition delay modifiers, preferably a cetane improver, to improve fuel detonation characteristics, particularly where the fuel composition is used in compression ignited engines. Examples include nitrates, nitrites, and peroxides. A preferred ignition delay modifier is 2-ethylhexylnitrate (2-EHN), available from Ethyl Corporation under the trade designation HITEC 4103. Ammonium nitrate can also be used as a known cetane improver. Preferred compositions include about 0.1% to 0.4% by weight ignition delay modifier.

The fuel composition may include one or more lubricants to improve the lubricity of the fuel composition and for continued smooth operation of the fuel delivery system. Many conventional common oil-soluble and water soluble lubricity additives may be used and can be effective in amounts below about 200 ppm. The amount of lubricant generally ranges from about 0.04% to 0.1% by weight, more preferably from 0.04% to 0.05% by weight. An example of a suitable lubricants include a combination of mono-, di-, and tri-acids of the phosphoric or carboxylic types, adducted to an organic backbone. The organic backbone preferably contains about 12 to 22 carbons. Examples include LUBRIZOL 522A and mixed esters of alkoxylated surfactants in the phosphate form, and di- and tri-acids of the Diels-Alder adducts of unsaturated fatty acids. The carboxylic types are more preferred because of their ashless character. A specific example of a suitable lubricant is DIACID 1550 (Atrachem's LATOL 1550 or Westvaco Chemicals' DIACID 1550), which is preferred due to its high functionality at low concentrations. The DIACID 1550 also has nonionic surfactant properties. Neutralization of the phosphoric and carboxylic acids, preferably with an alkanolamine, reduces possible corrosion problems caused as a result of the addition of the acid. Suitable alkanolamine neutralizers include amino methyl propanol, triethanolamine, and diethanolamine, with amino methyl propanol (available from Angus Chemical under the trade designation AMP-95) being in about 0.05 to 0.4% by weight neutralizer, more preferably about 0.06%.

With fuel being the continuous phase and the use of highly purified water, there is a low potential for corrosion and erosion, however; the fuel composition may also include one or more corrosion inhibitors, preferably one that does not contribute a significant level of inorganic ash to the composition. One example is amino methyl propanol (available from Angus Chemical under the trade designation AMP-95. The addition of citric acid will also inhibit corrosion via a small change in the pH of the water; citric acid also enhances the formation of the emulsion. Aminoalkanoic acids are preferred. An example of another suitable corrosion inhibitor is available from the Keil Chemical Division of Ferro Corporation under the trade designation SYNKAD 828. Preferred compositions include about 0.01% to about 0.05% by weight corrosion inhibitor.

Biocides known to those skilled in the art may also be added, provided they are ashless. Antifoam agents known to those skilled in the art may be added as well, provided they are ashless. The amount of antifoam agent preferably is not more than 0.0005% by weight.

The invert fuel emulsion composition may also include one or more coupling agents (hydrotropes) to maintain phase stability at high temperatures and shear pressures. High temperature and shear pressure stability is required, for example, in compression ignited (diesel) engines because all the fuel delivered to the injectors may not be burned to obtain the required power load in a given cycle. Thus, some fuel may be recirculated back to the fuel tank. The relatively high temperature of the recirculated fuel, coupled with the shear pressures encountered during recirculation, tends to cause phase separation in the absence of the coupling agent. Examples of preferred coupling agents include di- and tri-acids of the Diels-Alder adducts of unsaturated fatty acids. A specific example of a suitable coupling agent is DIACID 1550, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The invert fuel emulsion composition can include additives which perform multiple functions. For example, DIACID 1550 acts as a surfactant, lubricant, and coupling agent and citric acid has both emulsion enhancement and corrosion inhibitory properties. Similarly, AMP-95 acts as a neutralizer and helps maintain the pH of the fuel composition and ammonium nitrate, if used, acts as a cetane improver and an emulsion stabilizer.

Emulsion Process

The invert fuel emulsion compositions are preferably micro emulsions having an average droplet diameter of about 1 micron or less, more preferably ranging from about 0.1 micron to about 1 micron. The large aggregate surface area of the droplets of such an emulsion, however, can require a correspondingly large amount of surfactant. This requirement has been lowered by the surfactant package of the present invention. The combination of components in the surfactant package results tin a synergistic increase in surfactant efficiency greatly reducing the amount of surfactant needed to produce and maintain a stabile emulsion.

The process uses a fuel emulsion blending system including a first inlet circuit adapted for receiving hydrocarbon petroleum distillate from the source of hydrocarbon petroleum distillate; a second inlet circuit adapted for receiving invert fuel emulsion surfactant package and additives from the source of surfactant package and additives; a third inlet circuit adapted for receiving water from the source of water. The blending system further includes a first blending station adapted to mix the hydrocarbon petroleum distillate and surfactant package and additives and a second blending station adapted to mix the hydrocarbon and additive mixture received from the first blending station together with the water received from the source of water. The blending system further includes an emulsification station downstream of the blending stations, which is adapted to emulsify the mixture of hydrocarbon petroleum distillate, additives and water to yield a stable invert fuel emulsion. The present embodiment of the blending system is operatively associated with a blending system controller which is adapted to govern the flow of the hydrocarbon petroleum distillate, water and aqueous fuel emulsion additives thereby controlling the mixing ratio in accordance with prescribed blending ratios.

In an example of a continuous process, the surfactant package and additives are combined in the form of a stream, and then fed to a first in-line blending station where they are combined with a hydrocarbon petroleum distillate stream. The resulting product is then combined with water in a second in-line blending station to form the fuel composition, which is then aged in a reservoir and then pumped using a shear pump to a storage tank. In an alternate embodiment, a separate stream of the antifreeze (alcohol) is combined with the other additives in an in-line blending station and then this combined additive stream is fed to the first in-line blending station.

FIG. 1 illustrates a schematic representation of a preferred invert fuel emulsion blending system 12 having a plurality of ingredient inlets and an invert fuel emulsion outlet 14. As seen therein, the preferred embodiment of the fuel blending system 12 comprises a first fluid circuit 16 adapted for receiving hydrocarbon petroleum distillate at a first ingredient inlet 18 from a source of hydrocarbon petroleum distillate (not shown) and a second fluid circuit 20 adapted for receiving surfactant package and additives at a second ingredient inlet 22 from an additive storage tank 24 or similar such source of surfactant package and additives. The first fluid circuit 16 includes a fuel pump 26 for transferring the hydrocarbon petroleum distillate, preferably a diesel fuel, from the source of hydrocarbon petroleum distillate to the blending system 12 at a selected flow rate, a 10 micron filter 28, and a flow measurement device 30 adapted to measure the flow rate of the incoming hydrocarbon petroleum distillate stream. The second fluid circuit 22 also includes a pump 32 for transferring the surfactant package and additives from the storage tank 24 to the blending system 12 at prescribed flow rates. The fuel additive flow rate within the second fluid circuit 20 is controlled by a flow control valve 34 interposed between the additive storage tank 24 and the pump 26. As with the first fluid circuit 16, the second fluid circuit 20 also includes a micron filter 36 and a flow measurement device 38 adapted to measure the controlled flow rate of the incoming additive stream. The signals 40, 42 generated from the flow measurement devices 30, 38 associated with the first and second fluid circuits are further coupled as inputs to a blending system controller 44.

The first fluid circuit 16 transporting the hydrocarbon petroleum distillate and the second fluid circuit 20 adapted for supplying the surfactant package and fuel additives are coupled together and subsequently mixed together using a first in-line mixer 46. The resulting mixture of hydrocarbon petroleum distillate and surfactant package and fuel additives is then joined with a purified water stream supplied via a third fluid circuit 50 and subsequently mixed together using a second in-line mixer 51.

The third fluid circuit 50 includes a water pump 54 for transferring the purified water from a source of clean or purified water (not shown) at a selected flow rate to the blending system 12, a particulate filter 56 and a flow measurement device 58 adapted to measure the flow rate of the incoming purified water stream. The water pump 54, filter 56 and flow measurement device 58 are serially arranged within the third fluid circuit 50. The water flow rate within the third fluid circuit 50 is preferably controlled using a flow control valve 60 interposed between the clean water source and the water pump 54 proximate the third or water inlet 62. The third fluid circuit 50 also includes a specific conductance measurement device 64 disposed downstream of the flow measurement device 58 and adapted to monitor the quality of the water supplied to the blending system 12. The signals 66, 68 generated from the flow measurement device 58 and the specific conductance measurement device 64 in the third fluid circuit 50 are provided as inputs to the blending system controller 44. If the water quality is too poor or below a prescribed threshold, the blending system controller 44 disables the blending system 12 until corrective measures are taken. In the preferred embodiment, the water quality threshold, as measured using the specific conductance measurement device 64 should be no greater than 20 microsiemens per centimeter. As indicated above, the purified water from the third fluid circuit 50 is joined with the hydrocarbon petroleum distillate and fuel additive mixture and subsequently re-mixed using the second in-line mixer 52 or equivalent blending station equipment.

Figure 2:
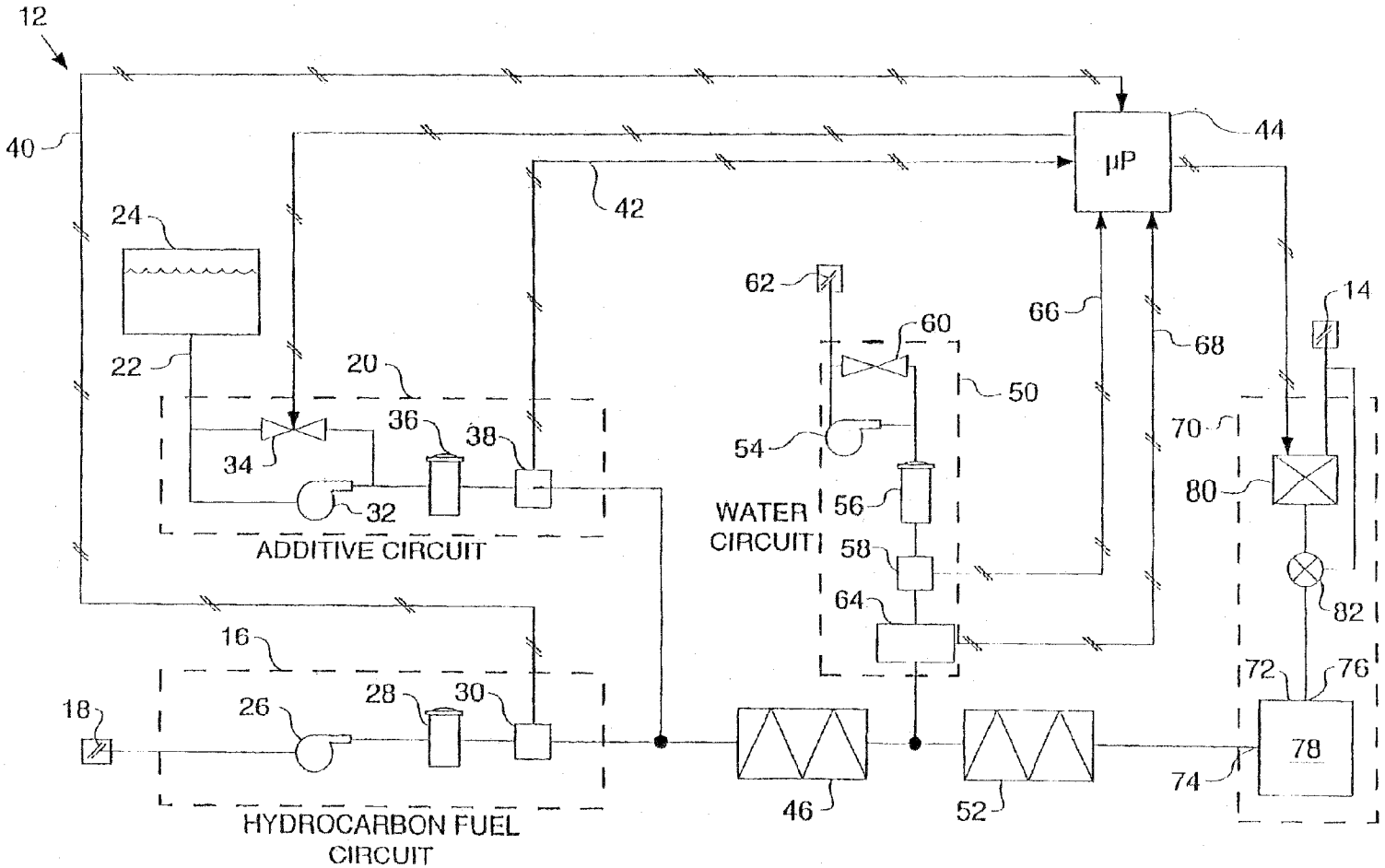
FIG. 2 is a schematic representation of an alternate emulsion blending system.

The resulting mixture or combination of hydrocarbon petroleum distillate, surfactant package and additives, and purified water are fed into an emulsification station 70. The emulsification station 70 includes an aging reservoir 72, and emulsifier. The aging reservoir 72 includes an inlet 74, an outlet 76 and a high volume chamber 78 or reservoir. The preferred embodiment of the blending system 12 operates using a three-minute aging time for the aqueous fuel emulsion. In other words, a blending system operating at an output flow rate of about 15 gallons per minute would utilize a 45-gallon tank as an aging reservoir. The incoming stream of hydrocarbon petroleum distillate, fuel emulsion additives, and purified water are fed into the aging reservoir 72 at a location that preferably provides continuous agitation to the reservoir. The preferred embodiment of the blending system 12 also includes a high shear pump 80 and a pressure regulating valve 32 disposed downstream of the aging reservoir 72 which provides the final aqueous fuel emulsion at the blending system outlet 14. FIG. 2 illustrates an alternative embodiment.

As indicated above, the blending system controller 44 accepts as inputs the signals generated by the various flow measurement devices in the first, second and third fluid circuits, as well as any signals generated by the water quality measurement device together with various operator inputs such as prescribe fuel mix ratios and provides control signals for the flow control valve in the second fluid circuit and the flow control valve in the third fluid circuit. The illustrated embodiment of the blending system is preferably configured such that the hydrocarbon petroleum distillate stream is not precisely controlled by is precisely measured. Conversely, the purified water feed line and the fuel additive feed line are precisely controlled and precisely measured to yield a prescribed water blend fuel mix. The illustrated embodiment also shows the hydrocarbon petroleum distillate, purified water and fuel additive streams to be continuous feed so that the proper fuel blend ratio is continuously delivered to the shear pump. Alternatively, however, it may be desirable to configure the blending system such that the purified water stream is precisely measured but not precisely controlled while precisely controlling and measure the hydrocarbon petroleum distillate feed line and the fuel additive feed line to yield a prescribed water blend fuel mix.

Examples of shear pumps capable of the necessary high shear rates are the Ross X Series mixer and the Kady Mill. As in the case of the batch process, the product is in the form of a stable, homogeneous, milky emulsion having an average droplet diameter of 1 micron or less, preferably ranging from about 0.1 to about 1 microns.

Engine Design

The aqueous fuel compositions according to the invention can be used tin internal combustion engines without substantially modifying the engine design. For example, the fuel compositions can be used without re-designing the engine to include inline homogenizers. To enhance fuel efficacy, however, several readily implemented changes are preferably incorporated in the engine structure.

The capacity of the engine fuel system may be increased to use the fuel compositions in diesel engines. The increased capacity is a function of the percentage of water in the fuel. The engine fuel system capacity is typically scaled by the following ratio:

$$\frac{\text{Lower Heating Value of Diesel Fuel (btu/gal)}}{\text{Lower Heating Value of Fuel Composition (btu/gal)}}$$

In many cases, the engine fuel system capacity can be increased sufficiently by increasing the injector orifice size. Other engines may require an increase in the capacity of the injection pump. In addition, an increase in the capacity of the fuel transfer pump may be required.

Some modifications to the engine may be required to compensate for fuel compositions with cetane quality lower than diesel fuel. This may include advancing the fuel injection timing to improve operation at light load, during starting, and under warm up conditions. In addition, a jacket water aftercooler may be required to warm the intake air under light load conditions. The use of a block heater or an inlet air heater may be required to improve cold starting capability.

The following examples will further describe the invention. These examples are intended only to be illustrative. Other variations and modifications may be made in form and detail described herein without departing from or limiting the scope of the invention which is set out in the attached claims.

EXAMPLE 1

A number of fuel emulsion compositions were made using a batch process. All formulations were made in approximately 2 liter batches containing 540 grams of water purified via reverse osmosis, and a fuel containing 1254 grams of EPA Emissions Certification diesel fuel and 6 grams of 2-EHN.

The surfactant package components were added and a coarse emulsion was formed with a hand blender. The resulting fuel composition was then aged and pumped using a Ross X Series shear pump to a storage tank. The products were in the form of a stable, homogeneous, milky emulsion having an average droplet diameter of less than 5 microns, about 1 micron or less.

The fuel emulsion, compositions were evaluated for stability and measured for phase separation after aging for 7 days. Samples of each composition were placed in vials, aged, and then the percent of any clear demarcation of water at the bottom or fuel at the top of the vial was measured as a function of the total volume. The relative stability of various prepared formulations is presented in Table 1.

TABLE 1

| | Concentration in ppm in Oil Phase | | | | |
|---|---|---|---|---|---|
| Formulation | Amide Surfactant | Block Co-Polymer | Additional Surfactant Stabilizers | | Rating |
| I | 6000 of SOA | 3000 of 17R2 | 800 of E464 | | 1 |
| II | 4000 of SOA | 3000 of 17R2 | 600 of E464 | 500 of DM430 | 10 |

TABLE 1-continued

| | Concentration in ppm in Oil Phase | | | | |
|---|---|---|---|---|---|
| Formulation | Amide Surfactant | Block Co-Polymer | Additional Surfactant Stabilizers | | Rating |
| III | 7000 of SOA | 4000 of 17R2 | 800 of E464 | | 8 |
| IV | 6000 of DS/280 | 3000 of 17R2 | 800 of E464 | | 10 |
| V | 6000 of SOA | 3000 of 25R2 | 800 of E464 | | 9 |
| VI | 7000 of SOA | 4000 of 25R2 | 400 of E464 | | 10 |
| VII | 5000 of SOA | 2500 of 17R2 | 800 of E464 | | 3 |
| VIII | 5000 of SOA | 3000 of 17R4 | 800 of E464 | | 4 |
| IX | 5000 of SOA | 3000 of 31R1 | 800 of E464 | | 5 |
| X | 5000 of SOA | 2500 of 17R2 | 800 of A-60 | | 6 |
| XI | 5000 of SOA | 2500 of 17R2 | 800 of E464 | 500 of S104 | 1 |
| XII | 3000 of SOA | 3000 of 27R2 | 3000 of T12 | 800 of E464 | 7 |
| XIII | 3000 of SOA | 2500 of 31R1 | 400 of S104 | 800 of A60 | 7 |
| XIV | 6000 of SOA | 3000 of L43 | 800 of E464 | | 4 |
| XV | 6000 of SOA | 3000 of L31 | 800 of E464 | | 5 |
| XVI | 6000 of SOA | 3000 of L61 | 800 of E464 | | 10 |
| XVII | 6000 Of SOA | 3000 of 17R2 | 800 of E464 | 300 of EMULSAN | 2 |
| XVIII | 6000 of SOA | 3000 of 17R2 | 800 of E464 | 500 of BX12 | 2 |
| XIX | 6000 Of SOA | 2000 of 17R2 | 600 of A-60 | 600 of S104 | 2 |
| XX | 4500 of SOA | 3000 of 17R2 | 800 of E464 | | 10 |

Rating on a scale of 1 to 10, 1 being more stabile.

Surfactants used in the above formulations:

| Notation | Manufacturer | Brand | Description |
|---|---|---|---|
| 17R2 | BASF | PLURONIC 17R2 | Block co-polymer |
| 17R4 | BASF | PLURONIC 17R4 | Block co-polymer |
| 25R2 | BASF | PLURONIC 25R2 | Block co-polymer |
| L43 | BASF | PLURONIC L43 | Block co-polymer |
| L31 | BASF | PLURONIC L31 | Block co-polymer |
| L61 | BASF | PLURONIC L61 | Block co-polymer |
| SOA | Scher Chemical | SCHERCOMID SO-A fatty oliamide DBA | 1:1 fatty acid Diethanolamide of oleic acid |
| E464 | ICI | HYPERMER E464 | Polymeric dispersant |
| A-60 | ICI | HYPERMER A-60 | Polymeric dispersant |
| S-104 | Air Products | SURFINAL 104 | Decyne diol unique nonfoaming wetter |
| BX12 | Lonza | BARLOX | Amine oxide |
| Emulsan | Emulsan | | Bio-polymer surfactant. |
| T12 | Okzo | ETHAMINE T12 | Amine othoxilate |
| DM 430 | | IGEPAL | Dinonylphenol |
| DS/280. | | | Ethoxylate |

EXAMPLE 2

Five invert fuel emulsion compositions—I, VIII, XVIII, XIX, and formulation XXI, a composition having a surfactant package containing 6000 ppm of SOA, 1500 ppm of L43, 2000 ppm of 17R2, and 800 ppm of E464, were prepared as in Example 1 with the addition of 200 ppm citric acid included in the purified water. A Ross X series mixer emulsifier was used in the process (ME 430-X-6).

The mean droplet size is noted on Table 2.

TABLE 2

| Sample | Shear pump Frequency | Shear Pump Flow Rate | Passes Through Pump | Droplet Size Microns Sauter Mean (D[3,2]) |
|---|---|---|---|---|
| XIX | 75 Hz | ¾ flow | 1 | 0.72 |
| XXI | | 17 gpm | 1 | 0.73 |
| XXI | | 17 gpm | 2 | 0.72 |
| XXI | 75 Hz | ¾ flow | 1 | 0.75 |
| XVIII | | 17 gpm | 1 | 0.88 |
| XIX | | 17 gpm | 1 | 0.66 |
| I | 75 Hz | Full flow | 1 | 0.68 |
| I | 75 Hz | ¼ flow | 1 | 0.94 |
| XVIII | | 17 gpm | 2 | 0.81 |
| XIX | | 17 gpm | 2 | 0.67 |
| VIII | | 17 gpm | 2 | 1.10 |
| XVIII | 75 Hz | ¾ flow | 1 | 0.69 |
| VIII | | 17 gpm | 1 | 0.75 |
| I | | 17 gpm | 1 | 0.81 |
| I | | 17 gpm | 2 | 0.75 |
| VIII | 75 Hz | ¾ flow | 1 | 0.61 |

EXAMPLE 3

Fuel compositions prepared according to Examples 1 and 2 in which the fuel was a California Air Resource Board diesel fuel were run in a diesel engine to monitor NOx and particulate emissions. The engine used was a Caterpillar 12 liter compression-ignited truck engine (four stroke, fully electronic, direct injected engine with electronic unit injectors, a turbocharger, and a four valve quiescent head). The Caterpillar C-12 truck engine was rated at 410 hp at 1800 rpm with a peak torque of 2200 N-m at 1200. A simulated air-to-air aftercooler (43° C. inlet manifold temperature) was used.

The electronic unit injectors were changed to increase the quantity of fuel injected into the cylinder. As modified, the electronic unit injector Caterpillar Part Number 116-8800 replaced the standard injector Caterpillar Part Number 116-8888. In addition, the electronic control strategy was optimized with respect to emissions, fuel consumption, and cold starting.

Tests were performed on standard diesel fuels and on fuel emulsions of Example 1 and fuel emulsions prepared as in Example 1. The tests were performed at 1800 rpm and 228 kW, 122 rpm and 197 kW, and 1800 rpm and 152 kW. Particulate emissions and NOx+HC emissions for standard diesel fuels and for fuel emulsions are shown in the following table:

| Engine | | Standard diesel fuel | Fuel emulsions |
|---|---|---|---|
| 1800 rpm 228 kW | Particulate emissions (g/hp - hr) | about 0.040 to about 0.055 | about 0.070 |
| | NOx + HC emissions (g/hp - hr) | about 2.5 to about 4.5 | about 1.6 |
| 1200 rpm 197 kW | Particulate emissions (g/hp - hr) | about 0.03 to about 0.033 | about 0.070 |
| | NOx + HC emissions (g/hp - hr) | about 3.5 to about 6.5 | about 1.8 |
| 1800 rpm 152 kW | Particulate emissions (g/hp - hr) | about 0.068 to about 0.084 | about 0.058 |
| | NOx + HC emissions (g/hp - hr) | about 2.3 to about 4.5 | about 1.6 |

EXAMPLE 4

The Ball on Three Disks (BOTD) lubricity test was utilized to assess; the lubricity of the fuel compositions. This test was developed by Falex Corporation to assess the lubricity of various diesel fuels and their additives. The average wear scar diameter is used to assess fuel composition lubricity; a smaller scar diameter implies a higher fuel composition lubricity. Typical diesel fuel will have a scar diameter of 0.45 mm to 0.55 mm. Fuel emulsions of Formulation I and Formulation I with oil soluble lubricity additive ranged from about 0.703 to about 0.850.

EXAMPLE 5

A formulation is 540 grams of water purified via reverse osmosis, and a fuel containing 1254 grams of EPA Emissions Certification diesel fuel and 6 grams of 2-EHN.

The surfactant package components are combined in the form of a stream, and then fed to a first in-line blending station where they are combined with a fuel stream. The resulting product is then combined with the purified water in a second in-line blending station to form the fuel composition. The fuel composition is then aged and pumped using a Ross X Series shear pump to a storage tank. The product is in the form of a stable, homogeneous, milky emulsion having an average droplet diameter of less than about 5 microns, preferably about 1 micron or less.

EXAMPLE 6

Cetane measurements were taken of standard diesel and emulsion formulations containing various amounts of 2-EHN. The results are shown in Table 3 below.

| | % 2-EHN | CFR Cetane # | CVCA Cetane # |
|---|---|---|---|
| Diesel | 0 | 41 | 39 |
| Diesel | 0.5 | 48 | 62 |
| Formulation | 0 | 27 | 29 |
| Formulation | 0.18 | 25 | 29 |
| Formulation | 0.36 | 28 | 33 |

A preferred fuel composition has the following composition: diesel, purified water, methanol, 2-ethylhexylnitraite, SO-A, 17R2 and E-464.

While embodiments and applications of this disclosure have been shown and described, it would be apparent to those skilled in the art that many more modifications than mentioned above are possible without departing from the inventive concepts herein. The disclosure, therefore, is not to be restricted except in the spirit of the appended claims.

What is claimed is:

1. A method for producing a high stability, low emission, invert fuel emulsion composition, comprising:

blending a flow of additives including a surfactant package with a flow of a hydrocarbon petroleum distillate fuel in a first in-line blending station to create a first composition, said surfactant package includes a primary surfactant, a block copolymer, and a polymeric dispersant, and said hydrocarbon petroleum distillate fuel is a continuous phase of the emulsion;

blending purified water with said first composition in a second in-line blending station to produce a second composition;

aging said second composition to produce an aged composition; and passing said aged composition through a shear pump.

2. The method of claim 1, wherein said aging is temperature dependent.

3. The method of claim 1, wherein the emulsion is about 5 wt. % to about 50 wt. % of said purified water and about 50 wt. % to about 95 wt. % of said hydrocarbon petroleum distillate fuel.

4. The method of claim 1, wherein said primary surfactant is about 3,000 parts per million to about 10,000 parts per million.

5. The method of claim 1, wherein said primary surfactant is selected from a group consisting of nonionic surfactants, anionic surfactants, and amphoteric surfactants.

6. The method of claim 1, wherein said primary surfactant is selected from a group consisting of unsubstituted, mono-substituted amides of saturated $C_{12}$-$C_{22}$ fatty acids, unsubstituted, di-substituted amides of saturated $C_{12}$-$C_{22}$ fatty acids, unsubstituted, mono-substituted amides of unsaturated $C_{12}$-$C_{22}$ fatty acids, and unsubstituted, di-substituted amides of unsaturated $C_{12}$-$C_{22}$ fatty acids.

7. The method of claim 6, wherein said mono-substituted amides and di-substituted amides are substituted by substituents selected, independently of each other, from a group consisting of straight and branched, unsubstituted alkyls having 1 to 4 carbon atoms, straight and branched, substituted alkyls having 1 to 4 carbon atoms, straight and branched, unsubstituted alkanols having 1 to 4 carbon atoms, straight and branched, substituted alkanols having 1 to 4 carbon atoms, and aryls.

8. The method of claim 1, wherein said primary surfactant is a 1:1 fatty acid diethanolamide of oleic acid.

9. The method of claim 1, wherein said block copolymer is at about 1,000 ppm to about 5,000 ppm.

10. The method of claim 1, wherein said block copolymer is an ethylene oxide/propylene oxide block copolymer.

11. The method of claim 1, wherein said block copolymer is selected from a group consisting of an ethylene oxide/propylene oxide block copolymer having about 10 wt. % to about 40 wt. % ethylene oxide and an ethylene oxide/propylene oxide block copolymer having about 900 molecular weight to about 2,500 molecular weight propylene oxide.

12. The method of claim 1, wherein said block copolymer is selected from a group consisting of an ethylene oxide/propylene oxide block copolymer having about 20 wt. % ethylene oxide and an ethylene oxide/propylene oxide block copolymer having about 1,700 molecular weight propylene oxide.

13. The method of claim 1, wherein said polymeric dispersant is at about 100 ppm to about 1,000 ppm.

14. The method of claim 1, wherein said polymeric dispersant is a non-ionic polymeric dispersant.

15. The method of claim 1, wherein the emulsion has an average droplet size of less than about 1 micron.

16. The method of claim 1, wherein the emulsion has an average droplet size of about 0.1 microns to about 1 micron.

17. The method of claim 1, further comprising:

at least one component selected from a group consisting of lubricants, corrosion inhibitors, antifreezes, ignition delay modifiers, cetane improvers, stabilizers, and rheology modifiers.

18. The method of claim 17, wherein said flow of additives comprises said surfactant package and at least one of said at least one component.

19. The method of claim 17, wherein said flow of additives comprises a flow of said antifreeze and at least one of said at least one component blended in a third in-line blending station.

* * * * *